US011727908B2

(12) United States Patent
Iwata et al.

(10) Patent No.: US 11,727,908 B2
(45) Date of Patent: Aug. 15, 2023

(54) RECORDING DEVICE

(71) Applicant: SEIKO EPSON CORPORATION, Tokyo (JP)

(72) Inventors: Morio Iwata, Matsumoto (JP); Kazuhisa Takeda, Shiojiri (JP); Mafumi Kobayashi, Shiojiri (JP); Katsumi Yamada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 437 days.

(21) Appl. No.: 16/950,529

(22) Filed: Nov. 17, 2020

(65) Prior Publication Data

US 2021/0151023 A1 May 20, 2021

(30) Foreign Application Priority Data

Nov. 18, 2019 (JP) ..... 2019-207710

(51) Int. Cl.

| | |
|---|---|
| ***B41J 29/10*** | (2006.01) |
| ***G10K 11/00*** | (2006.01) |
| ***B41J 2/01*** | (2006.01) |
| ***B41J 11/00*** | (2006.01) |
| ***B65H 29/12*** | (2006.01) |
| ***B41J 13/02*** | (2006.01) |

(52) U.S. Cl.

CPC ..... *G10K 11/002* (2013.01); *B41J 2/01* (2013.01); *B41J 11/007* (2013.01); *B41J 13/02* (2013.01); *B41J 29/10* (2013.01); *B65H 29/125* (2013.01); *B65H 2513/42* (2013.01)

(58) Field of Classification Search

CPC ..... B41J 29/10; B41J 11/007; B41J 13/02

See application file for complete search history.

(56) References Cited

U.S. PATENT DOCUMENTS

| | | | | |
|---|---|---|---|---|
| 2009/0035018 | A1 | 2/2009 | Koga et al. | |
| 2009/0035019 | A1 | 2/2009 | Koga et al. | |
| 2015/0241838 | A1 | 8/2015 | Ishida et al. | |
| 2016/0225363 | A1* | 8/2016 | Ishida | G03G 21/1619 |
| 2016/0290439 | A1* | 10/2016 | Ishida | G03G 15/757 |
| 2017/0053633 | A1* | 2/2017 | Ishida | B41J 29/02 |
| 2018/0197522 | A1 | 7/2018 | Ishida et al. | |
| 2019/0272811 | A1 | 9/2019 | Ishida et al. | |
| 2020/0286458 | A1 | 9/2020 | Ishida et al. | |

FOREIGN PATENT DOCUMENTS

| | | |
|---|---|---|
| CN | 101357546 | 2/2009 |
| CN | 106415710 | 2/2017 |
| JP | 2005080756 | 3/2005 |
| JP | 2009-034847 | 2/2009 |
| JP | 2015-137142 | 7/2015 |
| JP | 2016-033649 | 3/2016 |
| JP | 6459089 | 1/2019 |

* cited by examiner

*Primary Examiner* — Scott A Richmond

(74) *Attorney, Agent, or Firm* — Workman Nydegger

(57) ABSTRACT

A recording device includes a recording unit configured to record on a medium, a transportation unit configured to transport the medium, a driving member, a plurality of gears configured to transmit a driving force of the driving member, and a sound absorber having an opening and a hollow space in communication with the opening. The sound absorber is located between a side end of the medium being transported by the transportation unit and the plurality of gears.

10 Claims, 17 Drawing Sheets

RECORDING DEVICE

The present application is based on, and claims priority from JP Application Serial Number 2019-207710, filed Nov. 18, 2019, the disclosure of which is hereby incorporated by reference herein in its entirety.

BACKGROUND

1. Technical Field

The present disclosure relates to a recording device.

2. Related Art

As an example of a recording device, JP-A-2015-137142 describes an image forming device including a sound absorber that absorbs a vibration sound generated by media being transported. The sound absorber is disposed on a transportation path along which media are transported. The sound absorber absorbs the vibration sound of the media to reduce the vibration sound.

Recording devices typically include a driving member. In such recording devices, a gear that transmits a driving force of the driving member makes a large drive noise in some cases. It is difficult for the sound absorber on the transportation path to absorb the gear drive noise. It is difficult for the sound absorber to reduce the gear drive noise.

SUMMARY

A recording device developed to solve the above-described problem includes a recording unit configured to record on a medium, a transportation unit configured to transport the medium, a driving member, a plurality of gears configured to transmit a driving force of the driving member, and a sound absorber having an opening and a hollow space in communication with the opening. The sound absorber is located between a side end of the medium being transported by the transportation unit and the plurality of gears.

DESCRIPTION OF EXEMPLARY EMBODIMENTS

Hereinafter, an embodiment of a recording device is described with reference to the drawings. The recording device is in the form of an ink jet printer that ejects ink, which is an example of a liquid, onto a medium, such as paper, to record an image including characters and photographs.

Figure 1:
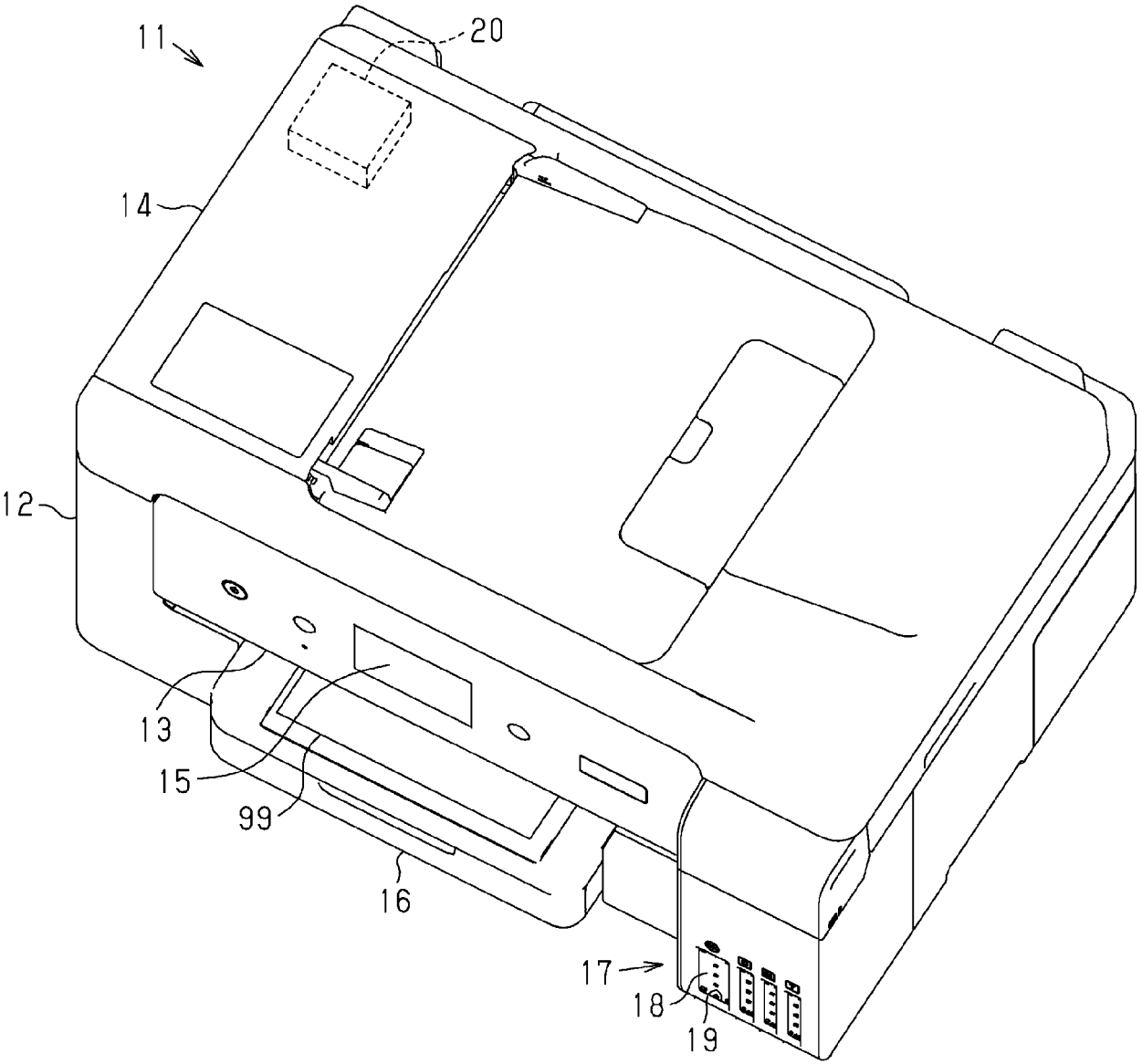
FIG. 1 is a perspective view illustrating an embodiment of a recording device.

As illustrated in FIG. 1, a recording device 11 includes a casing 12. The casing 12 is cuboid or substantially cuboid in shape. The casing 12 has an outlet 13 through which a medium 99 that has been recorded is ejected. The casing 12 has the outlet 13 on the front surface.

The recording device 11 includes a reading mechanism 14. The reading mechanism 14 is, for example, a scanner. The reading mechanism 14 is an upper portion of the recording device 11. The reading mechanism 14 reads an image on a document.

The recording device 11 includes a display 15, a cassette 16, and a housing 17. The display 15 displays information about the recording device 11. The display 15 is, for example, a liquid crystal display. In this embodiment, the casing 12 has the display 15 on the front surface. The display 15 of this embodiment is located above the outlet 13 on the front surface of the casing 12.

The cassette 16 houses blank media 99. The cassette 16 is detachable from the casing 12. The cassette 16 of this embodiment is attached to and detached from the casing 12 from the front side. In the recording device 11, when the cassette 16 is attached to the casing 12, the medium 99 is feedable from the cassette 16. The cassette 16 attached to the casing 12 is located below the display 15.

The housing 17 houses liquid containers 18. In this embodiment, the housing 17 houses four liquid containers 18. The housing 17 is a portion of the casing 12, for example. In other words, the liquid containers 18 in the housing 17 are housed in the casing 12.

The housing 17 has viewports 19. The liquid containers 18 are visible from the outside of the casing 12 through the viewports 19. For example, the viewports 19 are openings through which the liquid containers 18 are exposed. The viewports 19 of this embodiment are in the front surface of the casing 12. In this embodiment, the number of viewports 19 corresponds to the number of liquid containers 18. The viewports 19 may be portions of the housing 17 that are formed of a transparent material.

The liquid container 18 contains a liquid. The four liquid containers 18 contain different types of liquids. For example, the four liquid containers 18 contain different colors of ink. The liquid containers 18 are formed of a transparent or semi-transparent resin. This allows the user to check the liquid levels in the liquid containers 18 through the viewports 19.

The recording device 11 includes a controller 20. The controller 20 is a circuit including α: at least one processor that performs various processing tasks in accordance with a computer program, β: at least one dedicated hardware circuit, such as an integrated circuit for a special purpose, that performs at least one of various processing tasks, or y: a combination thereof. The processor includes a CPU and a memory, such as RAM and ROM. The memory stores program codes or instructions that allow the CPU to perform processing tasks. Examples of a memory or a computer readable medium include all readable media accessible by a general-purpose or dedicated computer. The controller 20 of this embodiment collectively controls various components of the recording device 11.

Figure 2:
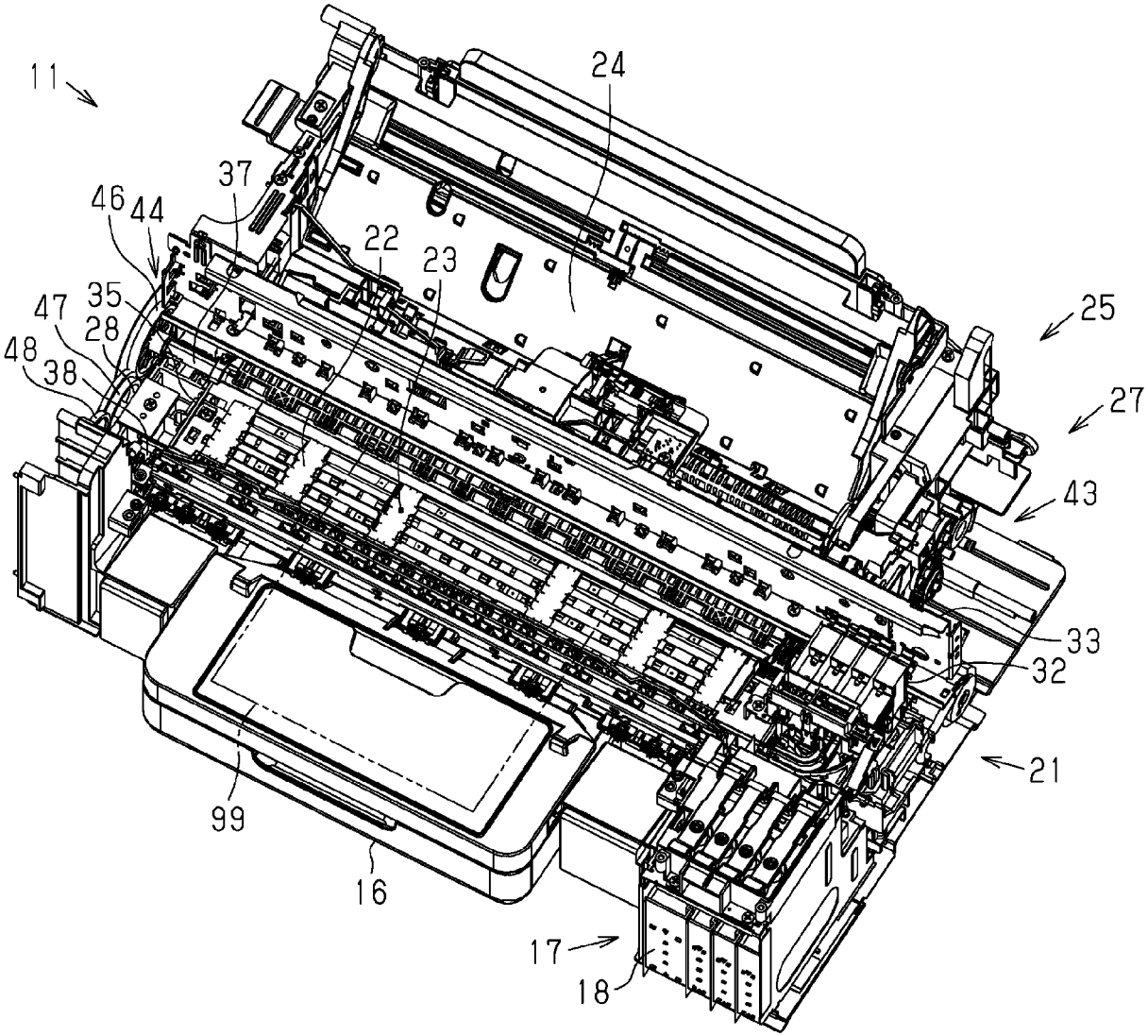
FIG. 2 is a perspective view illustrating an internal structure of the recording device.
Figure 3:
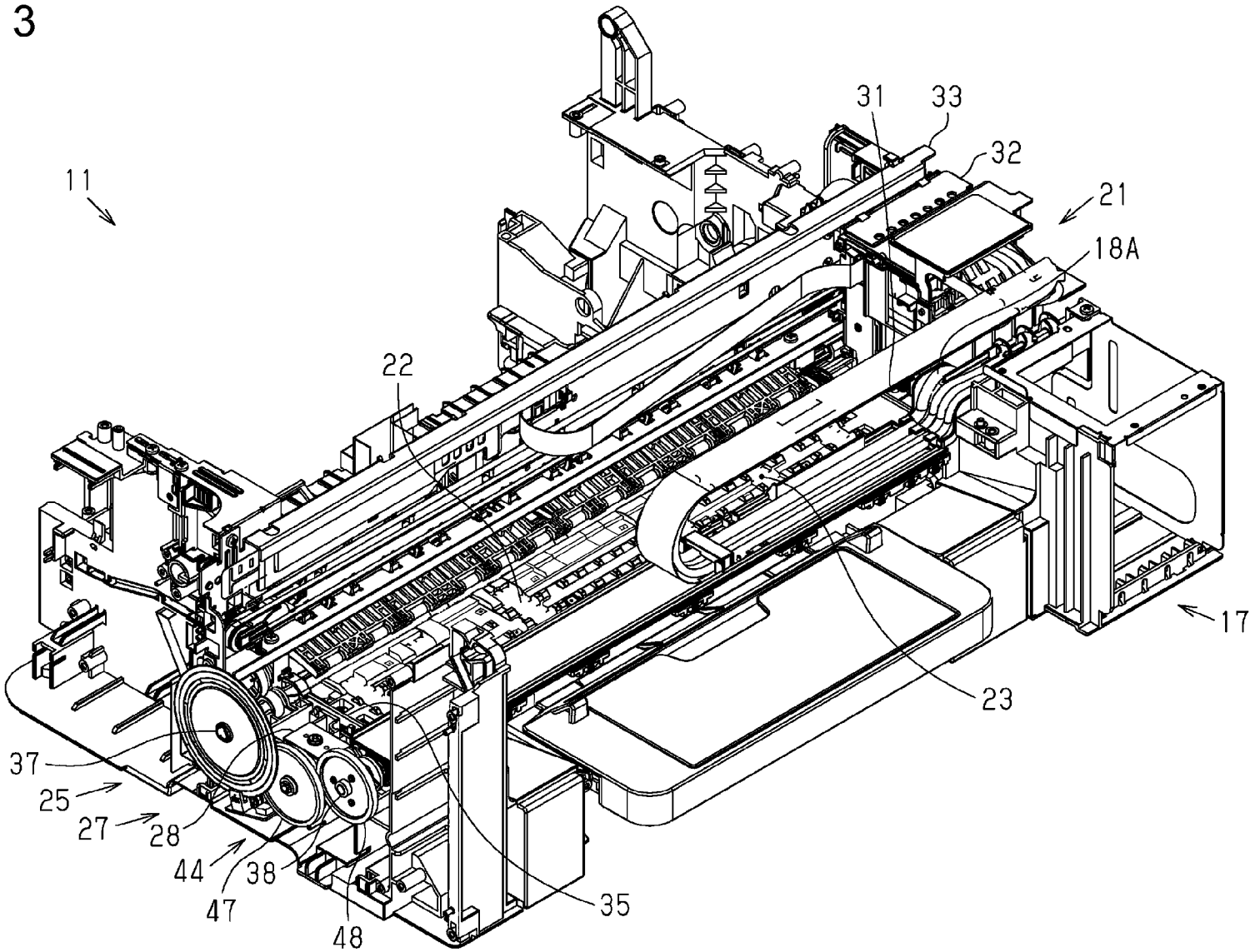
FIG. 3 is a perspective view illustrating the recording device without an inlet portion.
Figure 4:
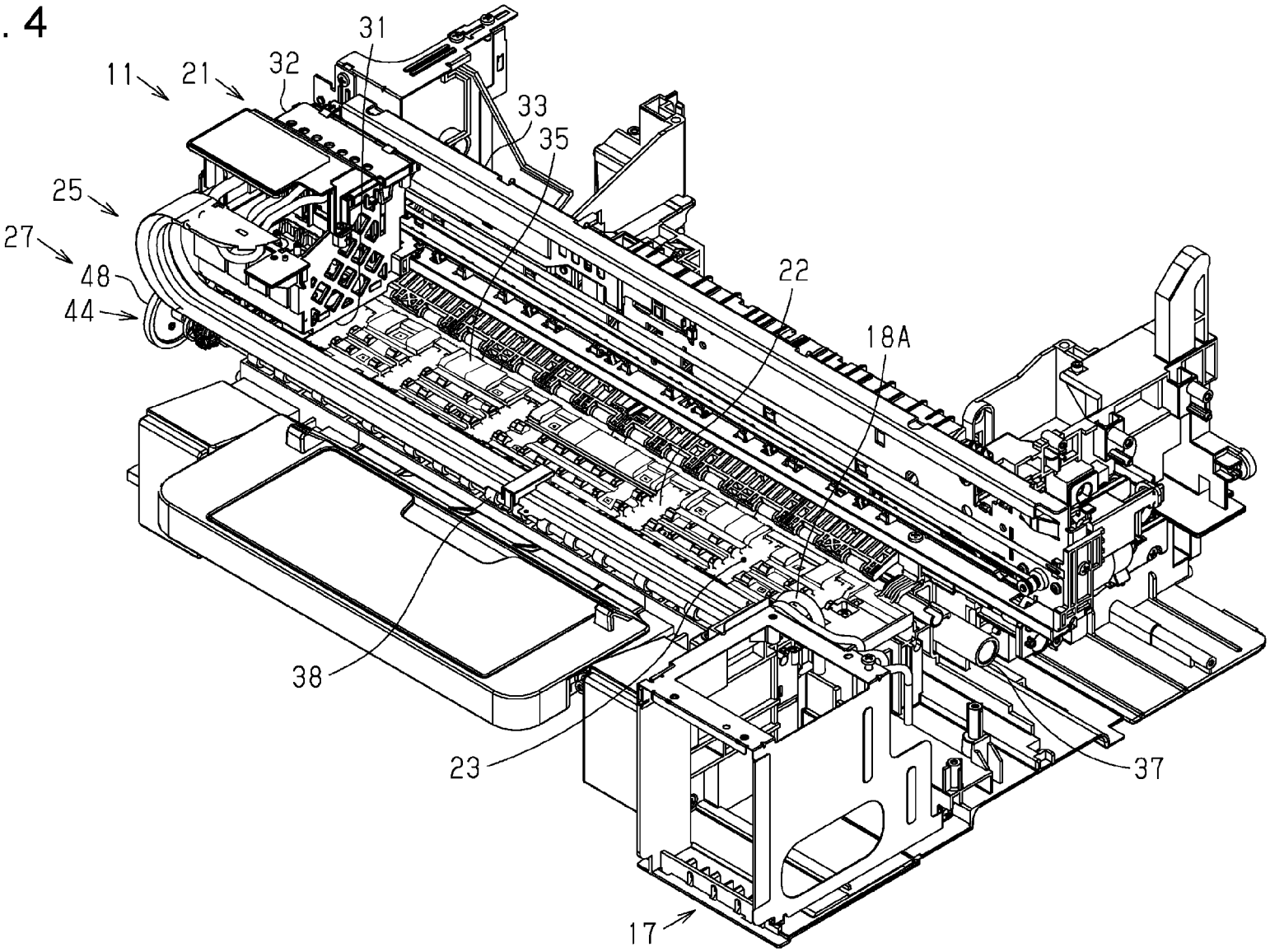
FIG. 4 is a perspective view illustrating the recording device viewed from a different angle than that in FIG. 3.

As illustrated in FIG. 2, the recording device 11 of this embodiment includes a recording unit 21, a support 22, a transportation path 23, and an inlet portion 24. As illustrated in FIGS. 3 and 4, the recording unit 21 is configured to record on the medium 99. The recording unit 21 of this embodiment includes a head 31, a carriage 32, and a guide frame 33.

The head 31 ejects a liquid onto the medium 99. Thus, an image is recorded on the medium 99. The head 31 is coupled to the liquid container 18 in the housing 17 through a tube 18A, for example. This enables the liquid in the liquid container 18 to be supplied to the head 31.

The head 31 is mounted on the carriage 32. The carriage 32 scans the medium 99. The recording device 11 of this embodiment is a serial printer. The recording device 11 may be a line printer that records one entire row on the medium 99 at one time.

The carriage 32 is normally positioned at a home position in the casing 12. For example, when the head 31 does not eject a liquid onto the medium 99, the carriage 32 rests at the home position. The carriage 32 illustrated in FIGS. 2 and 3 are positioned at the home position.

Figure 5:
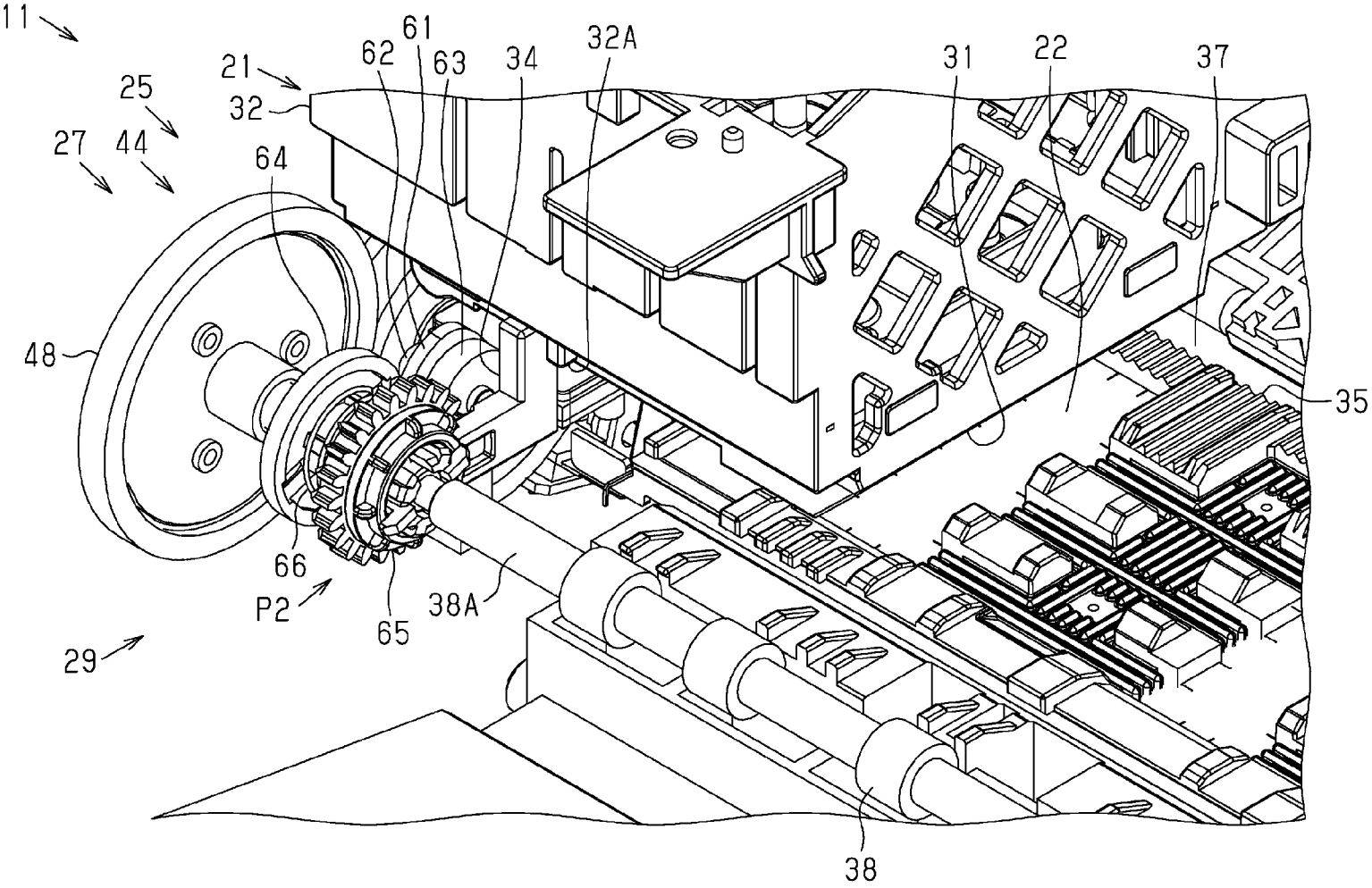
FIG. 5 is a perspective view illustrating a carriage.

As illustrated in FIG. 5, the carriage 32 of this embodiment has a protrusion 32A. The protrusion 32A extends from the bottom surface of the carriage 32. The protrusion 32A comes in contact with a lever 34, which will be described later, when the carriage 32 is positioned at a side opposite the home position. Contact between the protrusion 32A and the lever 34 activates a displacement mechanism 29, which will be described later.

As illustrated in FIGS. 3 and 4, the guide frame 33 supports the carriage 32. The guide frame 33 is long in one direction. The carriage 32 moves along the guide frame 33. Thus, the carriage 32 positioned at one end of the guide frame 33 is positioned at the home position. The carriage 32 positioned at the other end of the guide frame 33 is positioned at the side opposite the home position.

The support 22 supports a medium 99. The support 22 faces the recording unit 21. The support 22 supports the medium 99 being transported over an area to be recorded by the recording unit 21. The width of the support 22 is larger than the maximum width of the medium 99 recordable by the recording device 11.

The recording device 11 of this embodiment includes a frame member 35. The frame member 35 is long and extends in the same direction as the guide frame 33. The support 22 is a separate component from the frame member 35.

Figure 6:
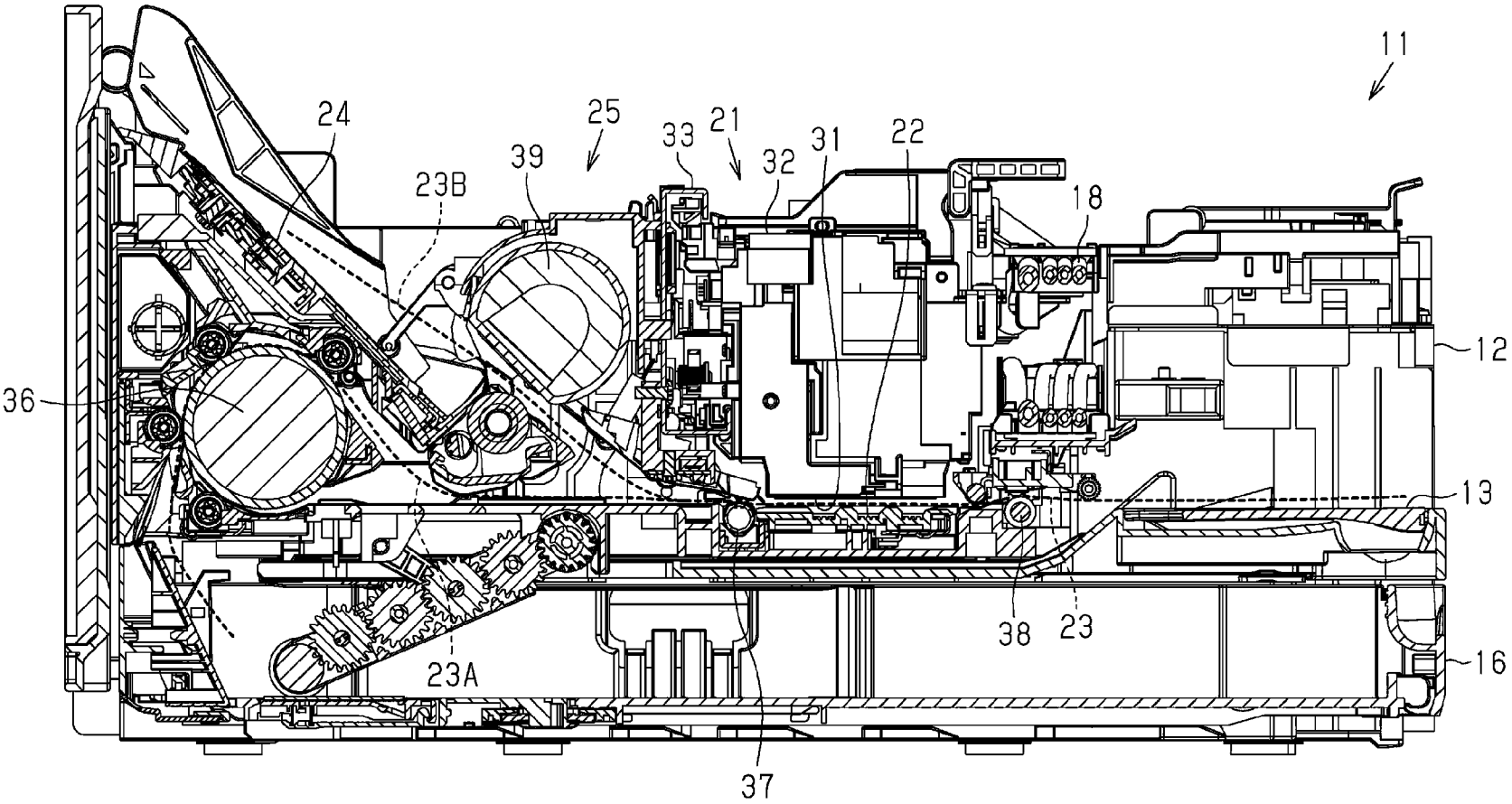
FIG. 6 is a cross-sectional view illustrating the recording device.

As illustrated in FIG. 6, the transportation path 23 is a route along which the medium 99 is transported. The transportation path 23 extends in the casing 12. The transportation path 23 passes a space between the recording unit 21 and the support 22. Thus, the medium 99 transported along the transportation path 23 is sent to the recording unit 21. The transportation path 23 of this embodiment includes a first route 23A extending from the cassette 16 toward the outlet 13. The transportation path 23 of this embodiment includes a second route 23B extending from the inlet portion 24 toward the recording unit 21. The second route 23B joins the first route 23A. The second route 23B joins the first route 23A at a position upstream of the recording unit 21.

The inlet portion 24 is able to have the medium 99 thereon. In the recording device 11, a medium 99 is feedable from the inlet portion 24 instead of the cassette 16. In this embodiment, the inlet portion 24 enables a medium 99 to be fed from the upper portion of the casing 12. The medium 99 fed from the inlet portion 24 to the casing 12 is transported along the transportation path 23.

The recording device 11 includes a transportation unit 25. The transportation unit 25 includes a first transportation roller 36 and a second transportation roller 37. The transportation unit 25 of this embodiment further includes a third transportation roller 38 and a fourth transportation roller 39. The first, second, third, and fourth transportation rollers 36, 37, 38, and 39 are disposed along the transportation path 23. The first, second, third, and fourth transportation rollers 36, 37, 38, and 39 rotate to transport the medium 99 along the transportation path 23. In this way, the transportation unit 25 transports the medium 99.

The first, second, and third transportation rollers 36, 37, and 38 are disposed in this order from upstream to downstream along the first route 23A. The first transportation roller 36 is located upstream of the recording unit 21 on the first route 23A. The first transportation roller 36 sends the medium 99 from the cassette 16 toward the recording unit 21.

The second transportation roller 37 is located upstream of the recording unit 21 on the first route 23A. Thus, the second transportation roller 37 is located between the recording unit 21 and the first transportation roller 36 on the first route 23A. The second transportation roller 37 sends the medium 99 sent by the first transportation roller 36 or the fourth transportation roller 39.

The third transportation roller 38 is located downstream of the recording unit 21 on the first route 23A. Thus, the third transportation roller 38 sends the recorded medium 99. The third transportation roller 38 sends the recorded medium 99 to eject the medium 99 through the outlet 13.

The fourth transportation roller 39 is disposed along the second route 23B. The fourth transportation roller 39 sends the medium 99 fed through the inlet portion 24. The fourth transportation roller 39 sends the medium 99 toward the second transportation roller 37. Thus, the second route 23B joins the first route 23A at a position between the first transportation roller 36 and the second transportation roller 37.

Figure 7:
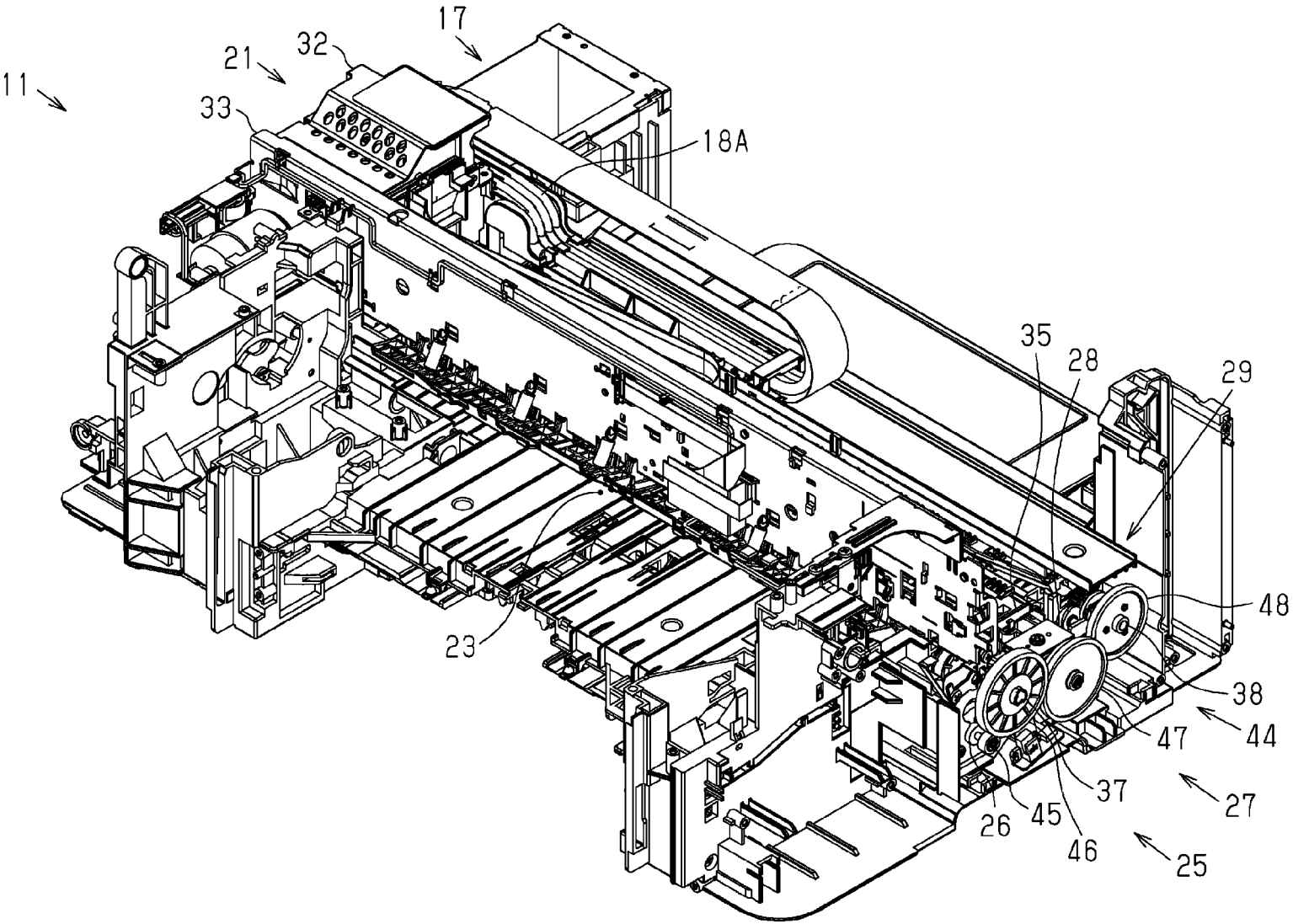
FIG. 7 is a perspective view illustrating the recording device viewed from a different angle than that in FIGS. 3 and 4.

As illustrated in FIG. 7, the recording device 11 includes a driving member 26, a transmission mechanism 27, and a sound absorber 28. The driving member 26 is, for example, a motor. The driving member 26 of this embodiment drives the transportation unit 25. The driving member 26 of this embodiment drives the first, second, third, and fourth transportation rollers 36, 37, 38, and 39.

Figure 8:
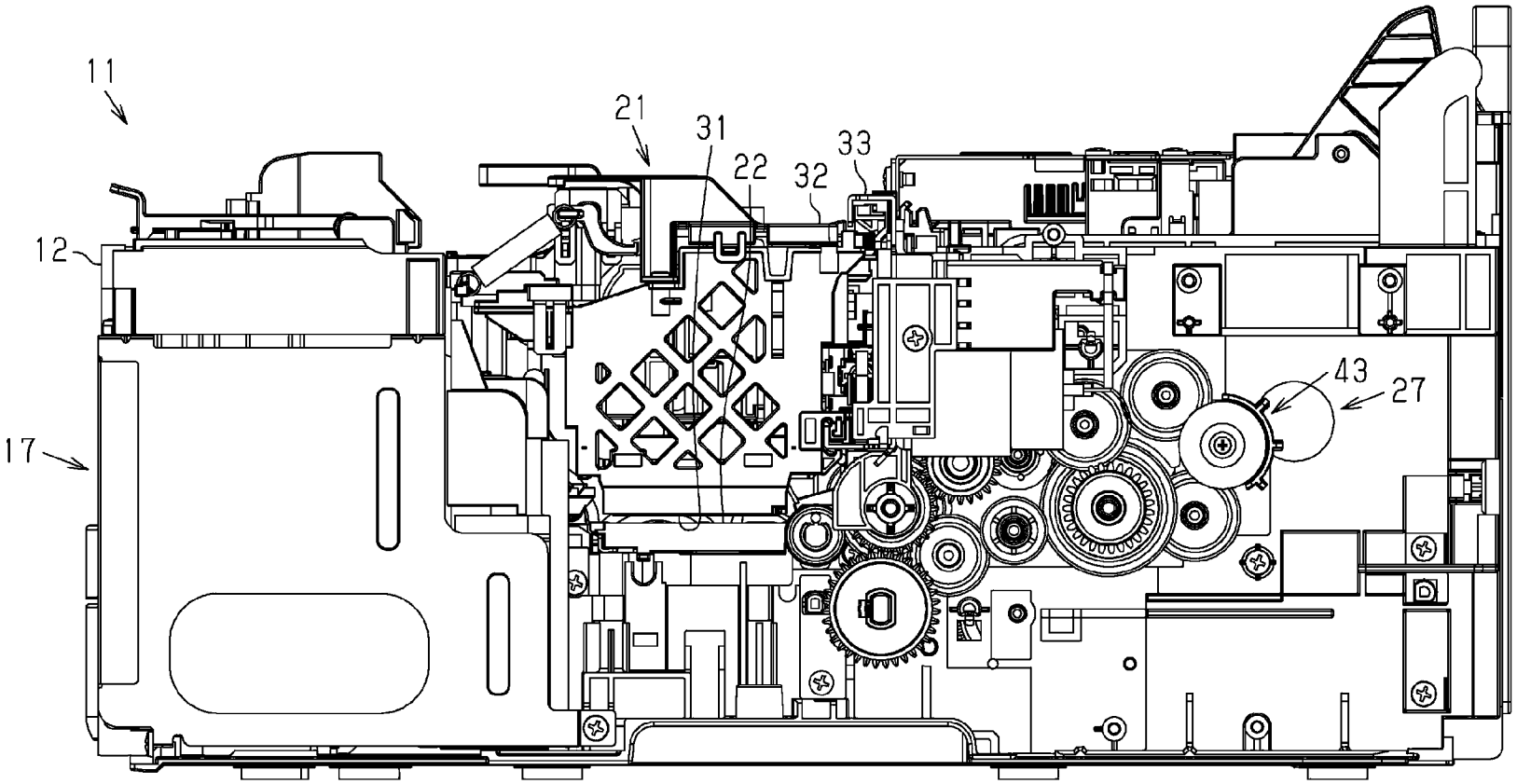
FIG. 8 is a side view illustrating a first transmission portion.

As illustrated in FIG. 2, the transmission mechanism 27 includes a first transmission portion 43 and a second transmission portion 44. The transmission mechanism 27 transmits a driving force of the driving member 26 to the transportation unit 25. As illustrated in FIG. 8, the first transmission portion 43 is located at an end of the recording device 11. The first transmission portion 43 in the recording device 11 is located at one end of the guide frame 33 in the longitudinal direction. The first transmission portion 43 transmits a driving force of the driving member 26 to the first transportation roller 36. The first transmission portion 43 of this embodiment also transmits a driving force of the driving member 26 to the fourth transportation roller 39. The first transmission portion 43 includes, for example, multiple gears. The first transmission portion 43 includes a gear attached to the rotation shaft of the first transportation roller 36. In the first transmission portion 43, a drive noise tends to be large at a position where the gears mesh.

As illustrated in FIG. 7, the second transmission portion 44 is located at an end of the recording device 11. In the recording device 11, the second transmission portion 44 is located at an end of the guide frame 33 in the longitudinal direction opposite the end where the first transmission portion 43 is located. The second transmission portion 44 transmits a driving force of the driving member 26 to the second transportation roller 37. The second transmission portion 44 of this embodiment also transmits a driving force of the driving member 26 to the third transportation roller 38. Thus, in this embodiment, the third transportation roller 38 rotates in synchronism with the second transportation roller 37.

The second transmission portion 44 includes multiple gears as the first transmission portion 43. The second transmission portion 44 of this embodiment includes first, second, third, and fourth gears 45, 46, 47, and 48.

Figure 9:
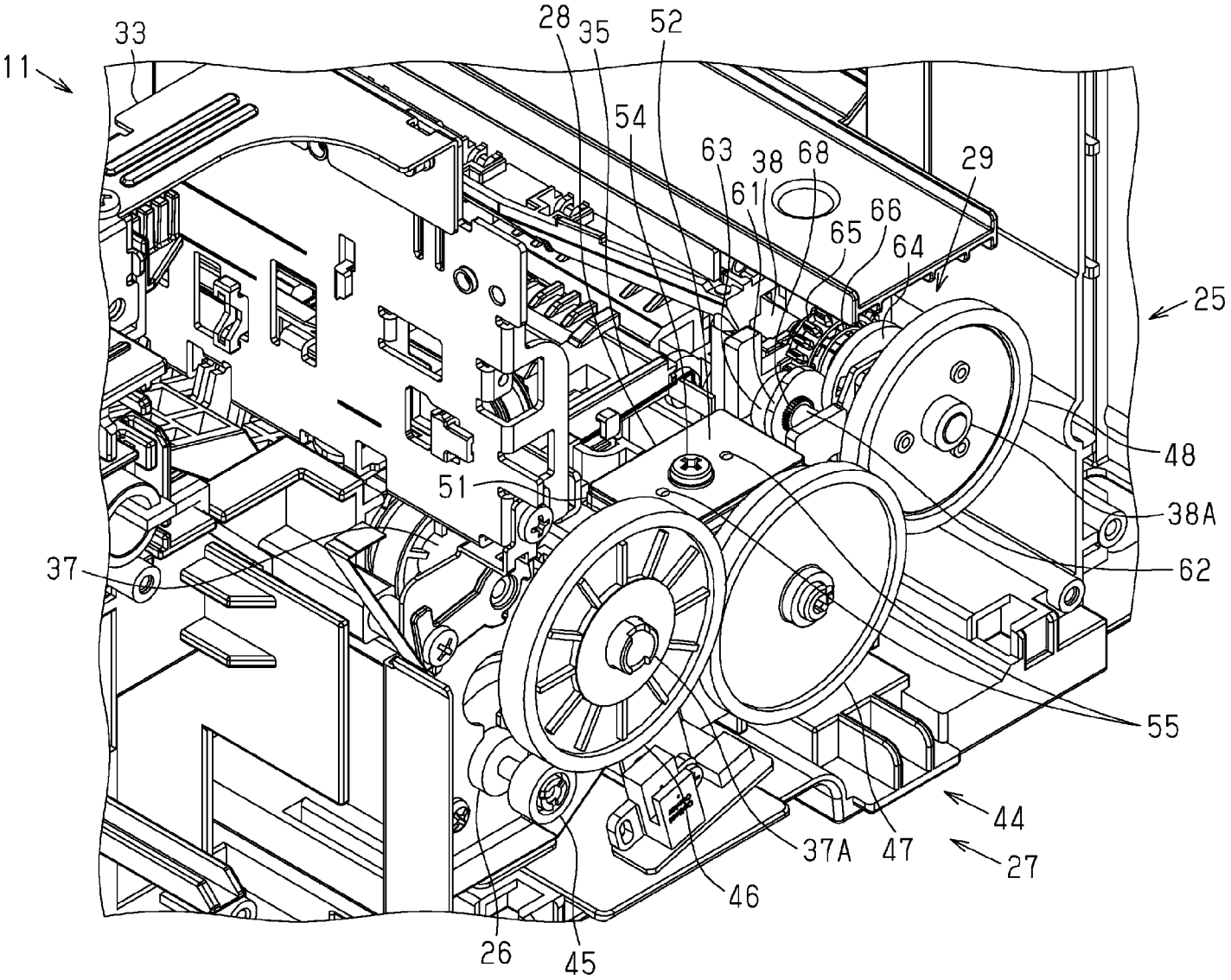
FIG. 9 is a magnified view of FIG. 7.

As illustrated in FIG. 9, the first gear 45 is attached to an output shaft of the driving member 26. Thus, the first gear 45 is rotated by the driving member 26. The first gear 45 meshes with the second gear 46. As in the first transmission portion 43, in the second transmission portion 44, a drive noise tends to be large at a position where the gears mesh. In particular, in the second transmission portion 44, a drive noise tends to be large at a position where the first gear 45 and the second gear 46 mesh.

The second gear 46 is attached to a rotation shaft 37A of the second transportation roller 37. The second gear 46 meshes with the first gear 45 and the third gear 47. Rotation of the first gear 45 rotates the second gear 46. Rotation of the second gear 46 rotates the second transportation roller 37.

The third gear 47 meshes with the second gear 46 and the fourth gear 48. Rotation of the second gear 46 rotates the third gear 47. The third gear 47 rotates in the same direction as the first gear 45.

The fourth gear 48 is attached to a rotation shaft 38A of the third transportation roller 38. Rotation of the third gear 47 rotates the fourth gear 48. Rotation of the fourth gear 48 rotates the third transportation roller 38. The fourth gear 48 rotates in the same direction as the second gear 46. Thus, the second transportation roller 37 rotates in the same direction as the third transportation roller 38.

The sound absorber 28 absorbs a drive noise generated by the gears of the transmission mechanism 27. The sound absorber 28 of this embodiment absorbs a drive noise generated by the second transmission portion 44. The sound absorber 28 is, for example, a Helmholtz resonator.

Figure 10:
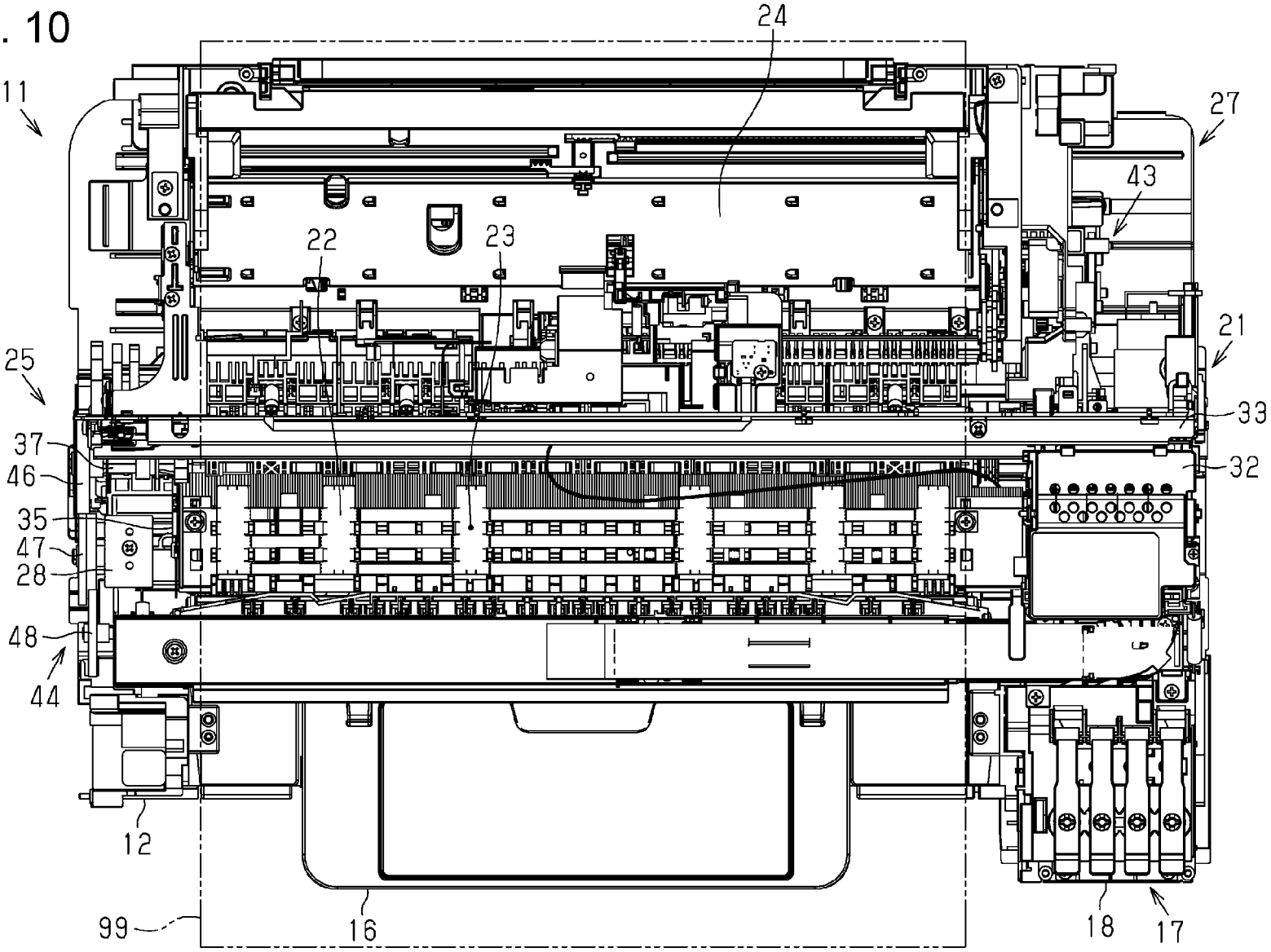
FIG. 10 is a top view illustrating an internal structure of the recording device.

As illustrated in FIG. 10, the sound absorber 28 of this embodiment is located between the side end of the medium 99 being transported and the gears of the second transmission portion 44. Specifically described, the sound absorber 28 is located between one of the side ends of the medium 99 that is adjacent to the second transmission portion 44 and the second transmission portion 44. In other words, when the recording device 11 is viewed from the top, in the casing 12, the sound absorber 28 is located outward of a medium 99 that has the maximum width recordable by the recording device 11. In this configuration, when the recording device 11 is viewed from the top, the sound absorber 28 does not overlap the medium 99 being transported. Thus, when the recording device 11 is viewed from the top, the sound absorber 28 is located in a region over which the medium 99 is not transported.

In FIG. 10, the medium 99 indicated by a two-dot chain line has the maximum width recordable by the recording device 11 of this embodiment. The sound absorber 28 is located between the side end of this medium 99 and the gears of the second transmission portion 44 when the recording device 11 is viewed from the top.

The sound absorber 28 of this embodiment is adjacent to the support 22. Thus, the sound absorber 28 of this embodiment is located between the support 22 and the multiple gears of the second transmission portion 44. Specifically described, the sound absorber 28 is located between the support 22 and the second transmission portion 44 in the longitudinal direction of the guide frame 33.

Figure 11:
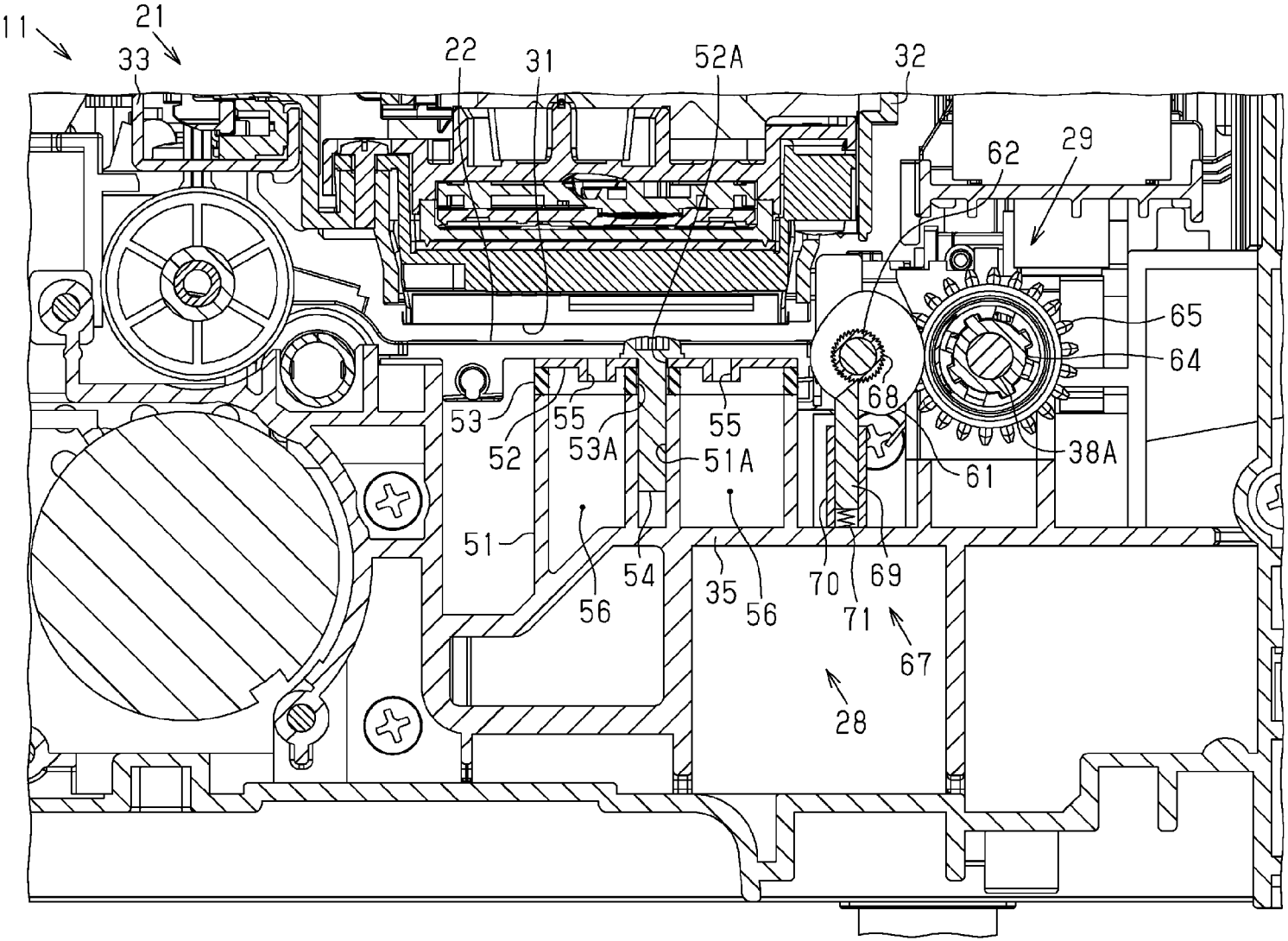
FIG. 11 is a cross-sectional view illustrating a sound absorber.

As illustrated in FIG. 11, the sound absorber 28 of this embodiment includes a case 51 and a cover 52. The sound absorber 28 of this embodiment further includes a screw 54. In this embodiment, the case 51 is located next to the support 22 in the casing 12. The case 51 has a screw hole 51A into which the screw 54 is inserted. The screw hole 51A has an inner groove engageable with the screw 54.

The cover 52 is attached to the case 51. The cover 52 is attached to the case 51 from the above, for example. The cover 52 has a first insertion hole 52A into which the screw 54 is inserted. The cover 52 is attached to the case 51 with the screw 54.

The screw 54 is inserted into the screw hole 51A through the first insertion hole 52A and a second insertion hole 53A. The screw 54 does not allow the cover 52 to detach from the case 51.

The cover 52 has openings 55. When the cover 52 is attached to the case 51, hollow spaces 56 are formed. The sound absorber 28 has the openings 55 and the hollow spaces 56.

The opening 55 is, for example, a tube. The opening 55 is in communication with the hollow space 56. With the cover 52 being attached to the case 51, the opening 55 of this embodiment extends toward the inside of the case 51. In other words, in this embodiment, the opening 55 extends downward. The opening 55 allows communication between the inside of the sound absorber 28 and the outside of the sound absorber 28.

Figure 12:
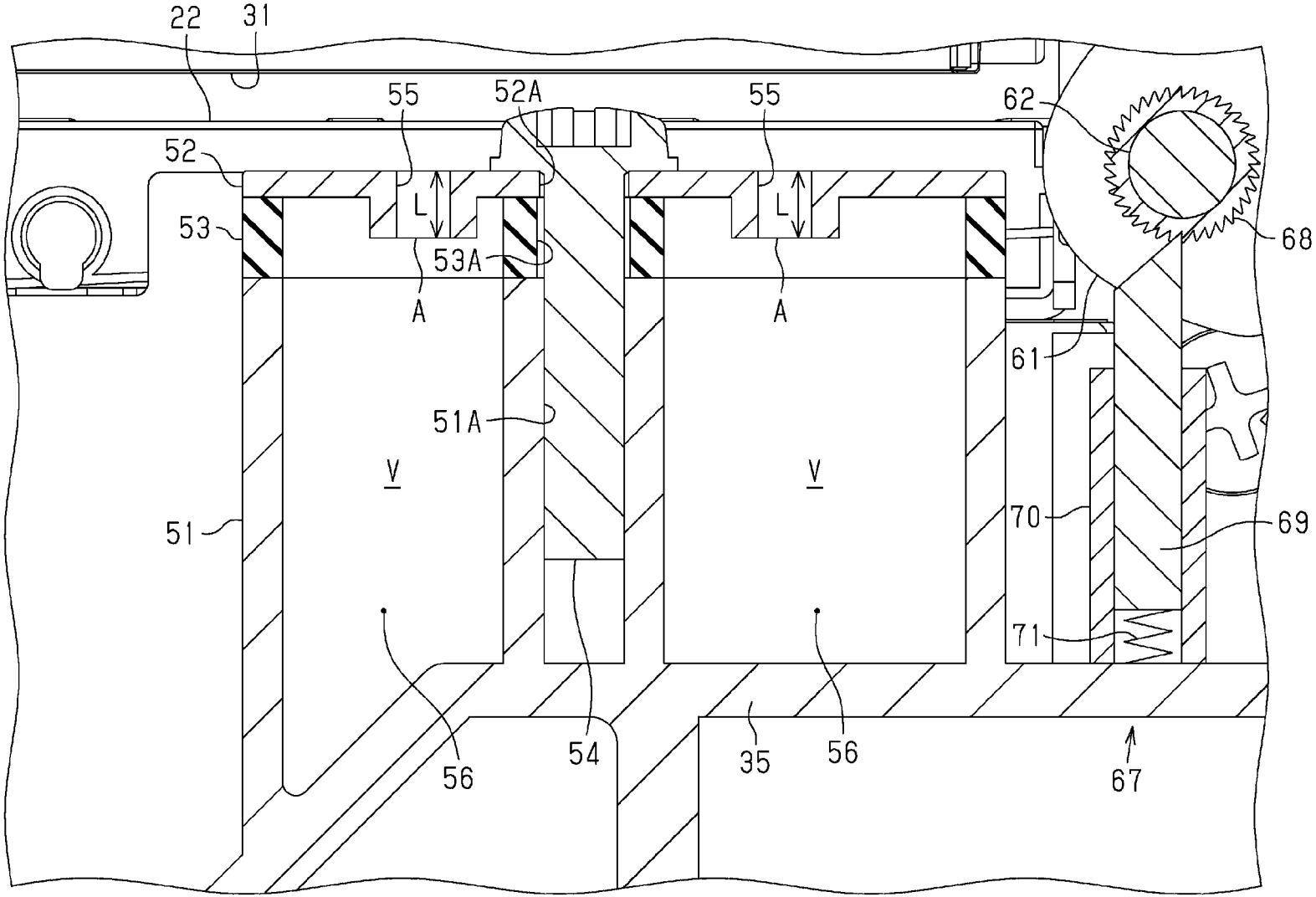
FIG. 12 is a magnified view of FIG. 11.

As illustrated in FIG. 12, the hollow space 56 is a space in the sound absorber 28. The hollow space 56 is defined, for example, by the case 51 and the cover 52. When a drive noise is generated by the gears of the second transmission portion 44, vibration of the drive noise enters the opening 55. At this time, the hollow space 56 may resonate with the drive noise. The air in the opening 55 vibrates when the hollow space 56 resonates with the drive noise. The vibrating air in the opening 55 causes friction with the opening 55, converting the kinetic energy of the air into the thermal energy. Accordingly, the drive noise is absorbed by the sound absorber 28. In this way, the sound absorber 28 absorbs the gear drive noise. If the opening 55 faces the source of a drive noise, vibrations of the drive noise readily enter the opening 55, improving the sound absorption effect.

The resonant frequency f of the sound absorber 28 is determined by the following formula:

$$f = \frac{c}{2\pi}\sqrt{\frac{A}{VL}}$$

in which c is the speed of sound, A is an opening area of the opening 55, V is a volume of the hollow space 56, and L is a length of the opening 55 or a length of the tube. The frequency of the sound to be absorbed by the sound absorber 28 is determined by using the opening area of the opening 55, the length of the opening 55, and the volume of the hollow space 56.

The sound absorber 28 of this embodiment has two openings 55 and two hollow spaces 56. In this embodiment, the two openings 55 have the same opening area. In this embodiment, the two openings 55 have the same length. In this embodiment, the two hollow spaces 56 have the same volume.

The sound absorber 28 of this embodiment includes an elastic member 53. The elastic member 53 is located between the case 51 and the cover 52. Thus, the cover 52 of this embodiment is attached to the case 51 with the elastic member 53 therebetween. In this embodiment, the hollow spaces 56 are defined by the case 51, the cover 52, and the elastic member 53.

The elastic member 53 is formed of an elastically deformable material, such as a rubber and an elastomer. The elastic member 53 can be stretched and compressed by an external force. The elastic member 53 seals between the case 51 and the cover 52. The elastic member 53 has the second insertion hole 53A into which the screw 54 is inserted.

In this embodiment, the cover 52 is movable relative to the case 51. In this embodiment, elastic deformation of the elastic member 53 moves the cover 52 relative to the case 51. In other words, the elastic deformation of the elastic member 53 changes the distance between the case 51 and the cover 52. The volume of the hollow space 56 changes as the cover 52 moves relative to the case 51. This changes the frequency of sound to be absorbed by the sound absorber 28.

Figure 13:
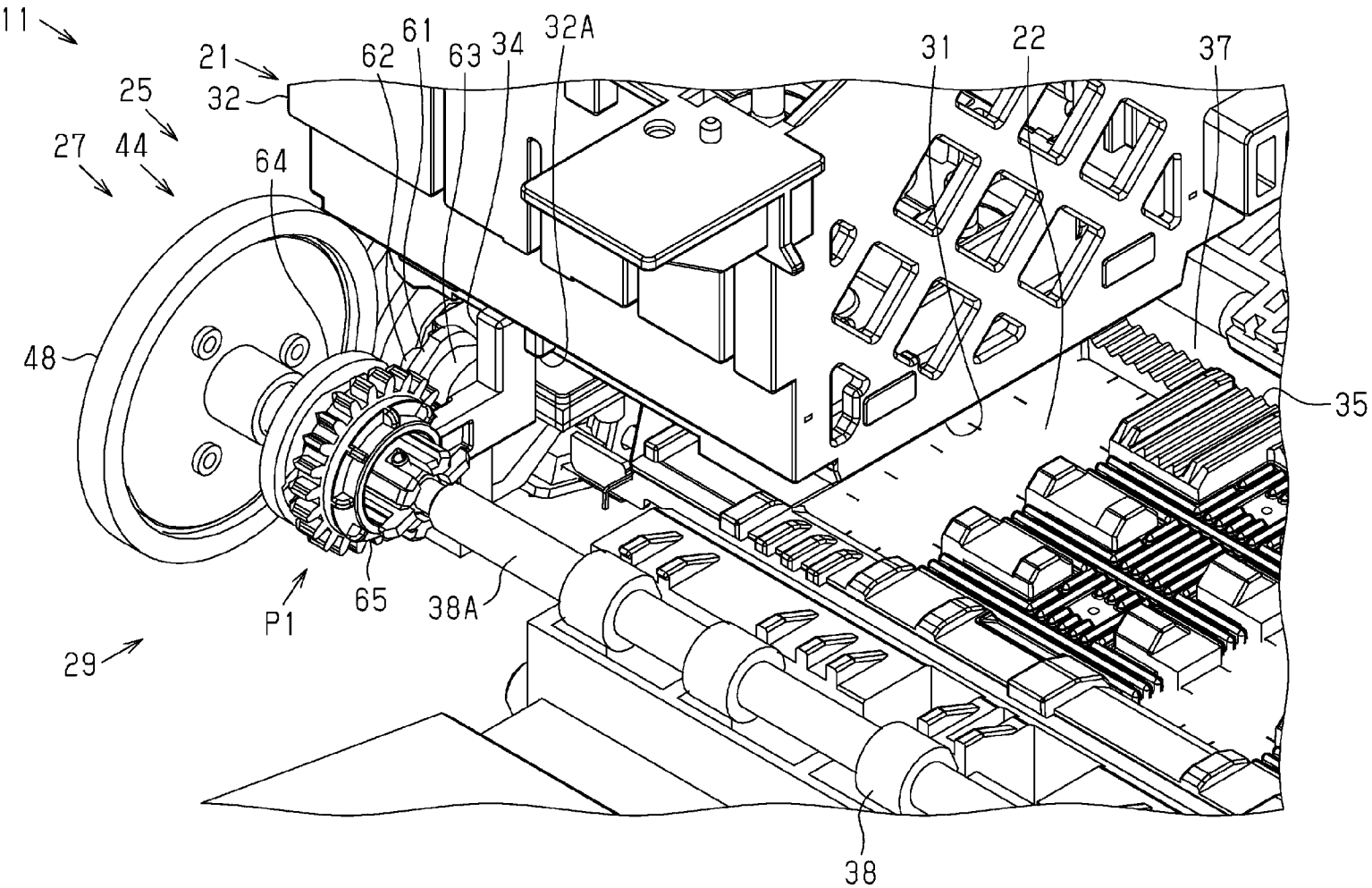
FIG. 13 is a perspective view illustrating the carriage positioned at a side opposite a home position.

As illustrated in FIGS. 5 and 13, the displacement mechanism 29 of this embodiment includes a cam 61, an attachment shaft 62, an interlocking gear 63, a holder 64, and a trigger gear 65. The displacement mechanism 29 of this embodiment further includes a pusher 66 and a lever 34. The displacement mechanism 29 is a mechanism that moves the cover 52 relative to the case 51.

The cam 61 is attached to the attachment shaft 62. The cam 61 is rotatable. The cam 61 of this embodiment rotates together with the attachment shaft 62. The cam 61 of this embodiment comes in contact with the cover 52 during the rotation.

The attachment shaft 62 is parallel to the rotation shaft 38A. The attachment shaft 62 is located between the sound absorber 28 and the rotation shaft 38A. The attachment shaft 62 is supported by, for example, the frame member 35. The interlocking gear 63 is attached to the attachment shaft 62. The interlocking gear 63 is adjacent to the cam 61 on the attachment shaft 62. The interlocking gear 63 rotates together with the cam 61. For example, the interlocking gear 63 is fixed to the cam 61. Thus, rotation of the interlocking gear 63 rotates the cam 61.

The holder 64 is attached to the rotation shaft 38A. The holder 64 is adjacent to the fourth gear 48 on the rotation shaft 38A. In other words, the holder 64 is located at the end portion of the rotation shaft 38A. The holder 64 rotates together with the rotation shaft 38A.

The trigger gear 65 is held by the holder 64. The trigger gear 65 rotates together with the holder 64. Thus, rotation of the rotation shaft 38A rotates both the holder 64 and the trigger gear 65. In other words, the trigger gear 65 is rotated by a driving force of the driving member 26.

The trigger gear 65 is movable to a first position P1 and to a second position P2. In this embodiment, the first position P1 and the second position P2 are positions on the holder 64. Thus, the trigger gear 65 held by the holder 64 moves along the rotation shaft 38A to the first position P1 or to the second position P2. In other words, the holder 64 holds the trigger gear 65 positioned at the first position P1 or the second position P2.

At the first position P1, the trigger gear 65 meshes with the interlocking gear 63. At the second position P2, the trigger gear 65 does not mesh with the interlocking gear 63. In this way, the trigger gear 65 is able to mesh with the interlocking gear 63. The trigger gear 65 is normally positioned at the second position P2. The trigger gear 65 in FIG. 5 is positioned at the second position P2. The trigger gear 65 in FIG. 13 is positioned at the first position P1. When the displacement mechanism 29 moves the cover 52, the trigger gear 65 is moved to the first position P1. On the rotation shaft 38A, the distance between the trigger gear 65 positioned at the first position P1 and the fourth gear 48 is shorter than the distance between the trigger gear 65 positioned at the second position P2 and the fourth gear 48.

The pusher 66 is attached to the holder 64. The pusher 66 is, for example, a spiral spring. The pusher 66 is in contact with the holder 64 at one end and in contact with the trigger gear 65 at the other end. The pusher 66 pushes the trigger gear 65 toward the second position P2 to move the trigger gear 65 to the second position P2.

The lever 34 is supported by the rotation shaft 38A. The lever 34 is always in contact with the trigger gear 65. The lever 34 is movable along the rotation shaft 38A. In other words, the lever 34 moves together with the trigger gear 65 moving along the rotation shaft 38A.

As illustrated in FIG. 13, when the carriage 32 moves from the home position toward the side opposite the home position, the protrusion 32A comes in contact with the lever 34. At this time, the lever 34 is pushed by the protrusion 32A as the carriage 32 moves. Thus, the lever 34 pushes the trigger gear 65 toward the pusher 66 as the carriage 32 moves. This moves the trigger gear 65 on the rotation shaft 38A toward the fourth gear 48. In other words, the lever 34 pushes the trigger gear 65 from the second position P2 to the first position P1. In short, the trigger gear 65 is moved from the second position P2 to the first position P1 by being pushed by the carriage 32. On the contrary, when the carriage 32 moves from the side opposite the home position toward the home position, the trigger gear 65 is moved from the first position P1 to the second position P2 by the pusher 66.

When the trigger gear 65 is moved from the second position P2 to the first position P1, the trigger gear 65 meshes with the interlocking gear 63. This allows transmission of the driving force of the driving member 26 to the cam 61. In other words, the cam 61 is rotated by the driving force of the driving member 26.

Figure 14:
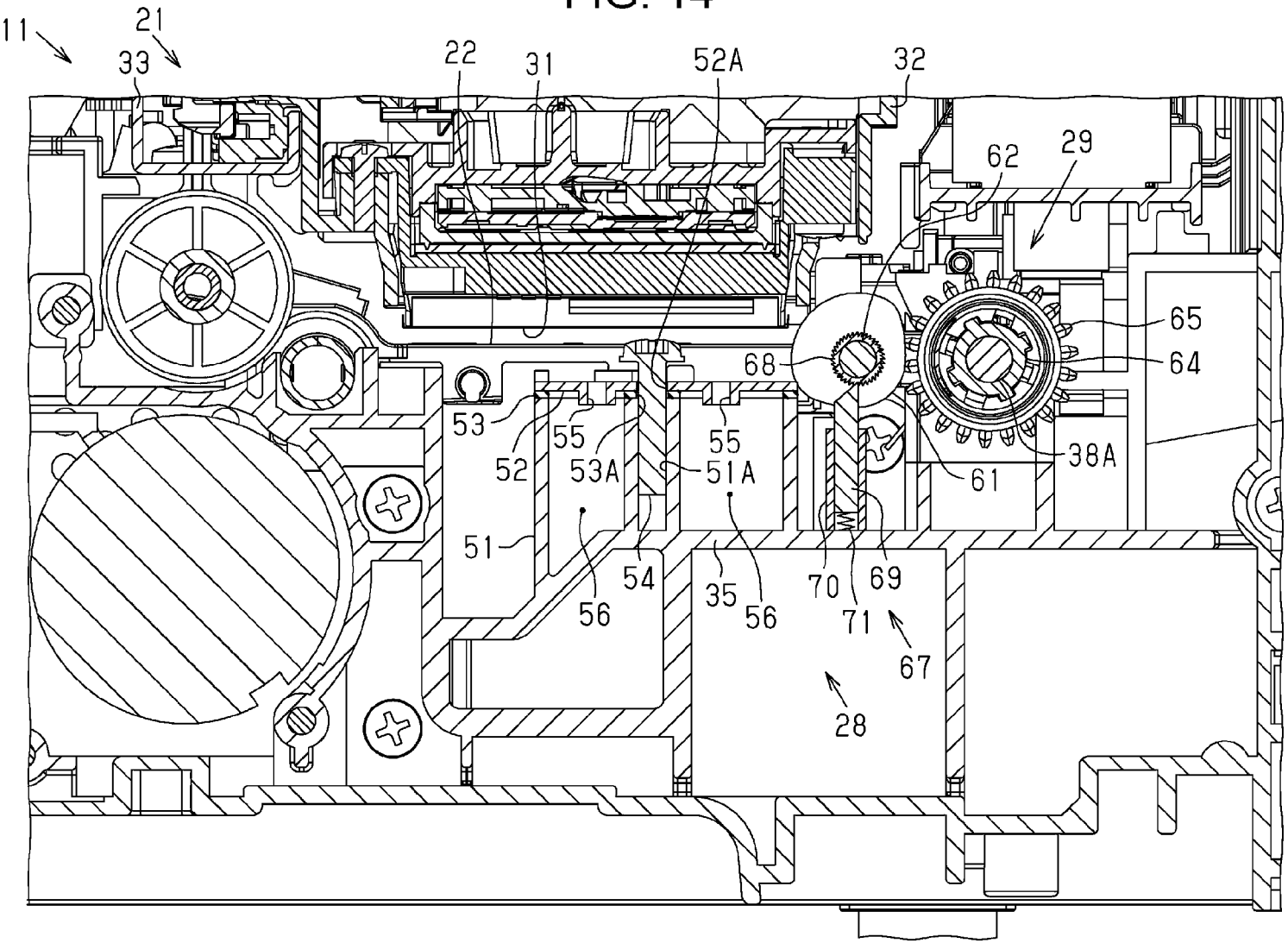
FIG. 14 is a cross-sectional view illustrating a cam pushing down a cover.

As illustrated in FIG. 14, the cam 61 comes in contact with the cover 52 when rotated. The rotating cam 61 pushes the cover 52 toward the case 51. The cam 61 in this embodiment pushes down the cover 52 toward the case 51 when rotated. The elastic member 53 is compressed when the cam 61 pushes down the cover 52. At this time, the cover 52 comes close to the case 51. This decreases the volume of the hollow space 56. In this way, the displacement mechanism 29 moves the cover 52 by rotating the cam 61.

The displacement mechanism 29 of this embodiment includes a locking mechanism 67. The locking mechanism 67 is a mechanism for preventing the rotation of the cam 61.

The locking mechanism 67 of this embodiment includes a ratchet gear 68, a pin 69, a pin holder 70, and a spring 71.

The ratchet gear 68 is attached to the attachment shaft 62. The ratchet gear 68 is adjacent to the cam 61 on the attachment shaft 62. The ratchet gear 68 rotates together with the cam 61. For example, the ratchet gear 68 is fixed to the cam 61. In other words, rotation of the cam 61 rotates the ratchet gear 68.

The pin 69 extends toward the ratchet gear 68. The pin 69 of this embodiment extends upward from a position below the ratchet gear 68 toward the ratchet gear 68. The front end of the pin 69 comes in contact with a tooth of the ratchet gear 68.

The pin holder 70 holds the pin 69. The pin holder 70 is, for example, a tubular member. The pin holder 70 holds the pin 69 inserted therein. The pin holder 70 of this embodiment is included in the frame member 35.

The spring 71 is in the pin holder 70 and located between the inner bottom surface of the pin holder 70 and the pin 69. The spring 71 pushes the pin 69 toward the latchet gear 68. The direction in which the cam 61 is rotated by the driving member 26 is referred to as a positive direction in this embodiment. The counterclockwise direction in FIG. 14 is the positive direction. When the cam 61 rotates in the positive direction, the latchet gear 68 rotates in the positive direction. At this time, a tooth of the latchet gear 68 and the front end of the pin 69 come in contact with each other at their sloping surfaces. Thus, the rotation of the latchet gear 68 applies a downward force to the front end of the pin 69. This compresses the spring 71 and moves down the pin 69. As described above, when the cam 61 rotates in the positive direction, the pin 69 does not prevent the rotation of the latchet gear 68.

When a rotational force in a direction opposite the positive direction or in the clockwise direction in FIG. 14 is applied to the cam 61, the rotational force in the opposite direction is also applied to the latchet gear 68. At this time, a tooth of the latchet gear 68 and the front end of the pin 69 come in contact with each other at the vertical surfaces, and thus a downward force is not applied to the pin 69. The latchet gear 68 does not push down the pin 69. In this case, the front end of the pin 69 catches against the tooth of the latchet gear 68. Thus, the pin 69 prevents rotation of the latchet gear 68. The locking mechanism 67 prevents rotation of the cam 61 in this way.

When the cam 61 pushes down the cover 52, the cover 52 receives a restoring force of the elastic member 53. In other words, due to the restoring force of the elastic member 53, a force to move the cover 52 upward is applied to the cover 52. Thus, a rotational force in the opposite direction is applied to the cam 61. The locking mechanism 67 prevents rotation of the cam 61 in the opposite direction. Thus, the cam 61 keeps pushing down the cover 52.

When the cover 52 needs to be moved upward, the cam 61 is further rotated in the counterclockwise direction to the original position or the pin 69 is pushed down by using an actuator, for example. When the pin 69 is moved down, the latchet gear 68 and the pin 69 are separated from each other, and thus the latchet gear 68 is unlocked. When the latchet gear 68 is unlocked, the cover 52 moves up due to a restoring force of the elastic member 53. In other words, the cover 52 moves up against the case 51. Thus, the cover 52 returns to the original position. This increases the volume of the hollow space 56.

Next, operations and effects of the above-described embodiment are described.

1. The sound absorber 28 is located between a side end of the medium 99 being transported by the transportation unit 25 and the gears. In this configuration, the sound absorber 28 is located near the gears. Thus, the sound absorber 28 is not covered by the medium and the vibration sound of the medium and the gear drive noise are effectively absorbed by one sound absorber. This reduces the gear drive noise.

2. The sound absorber 28 is located between the side end of the medium 99 and the second transmission portion 44. In this configuration, the sound absorber 28 is not covered by the medium and the vibration sound of the medium and the drive noise of the gears, which transmit the drive force of the driving member 26 to the transportation unit 25, are effectively absorbed by one sound absorber.

3. The sound absorber 28 is located between the support 22 and the gears. This contributes to a reduction in size of the recording device 11, because the sound absorber 28 is located between the support 22 and the gears.

4. The sound absorber 28 includes the case 51 and the cover 52 attached to the case 51 and having the openings 55. In this configuration, the sound absorber 28 has a simple structure.

5. The cover 52 is movable relative to the case 51. The volume of the sound absorber 28 changes as the cover 52 moves. The resonant frequency of the sound absorber 28 changes as the volume of the sound absorber 28 changes. Thus, the frequency of sound to be absorbed by the sound absorber 28 is changed when the cover 52 is moved.

6. The displacement mechanism 29 includes the cam 61 configured to come in contact with the cover 52, and the cam 61 moves the cover 52 when rotated. In this configuration, the displacement mechanism 29 moves up and down the cover 52. In other words, the frequency of sound to be absorbed by the sound absorber 28 is changed by the displacement mechanism 29.

7. The trigger gear 65 is movable to the first position P1 to mesh with the interlocking gear 63 and to the second position P2 to be unmeshed from the interlocking gear 63. The trigger gear 65 is moved from the second position P2 to the first position P1 by being pushed by the carriage 32. In this case, when the driving member 26 is driven with the trigger gear 65 being positioned at the first position P1, the cam 61 starts rotating together with the interlocking gear 63. In other words, the cover 52 is moved up and down by the driving force of the driving member 26 that drives the second transportation roller 37. The recording device 11 has a simpler structure than that including another drive source for moving up and down the cover 52.

8. The gears transmit the driving force of the driving member 26 to the second transportation roller 37. In this configuration, the sound absorber 28 is located near the gears that transmit the driving force of the driving member 26 to the second transportation roller 37. This reduces the drive noise of the gears driven by the driving member 26.

The present embodiment may be modified as below. The embodiment and the modifications may be combined without creating technical inconsistency.

The support 22 may be included in the frame member 35. This modification provides the following effect.

9. The case 51 is included in the frame member 35 constituting the support 22. In this configuration, the recording device 11 has a simpler structure than that including a case 51 independent from the frame member 35.

Figure 15:
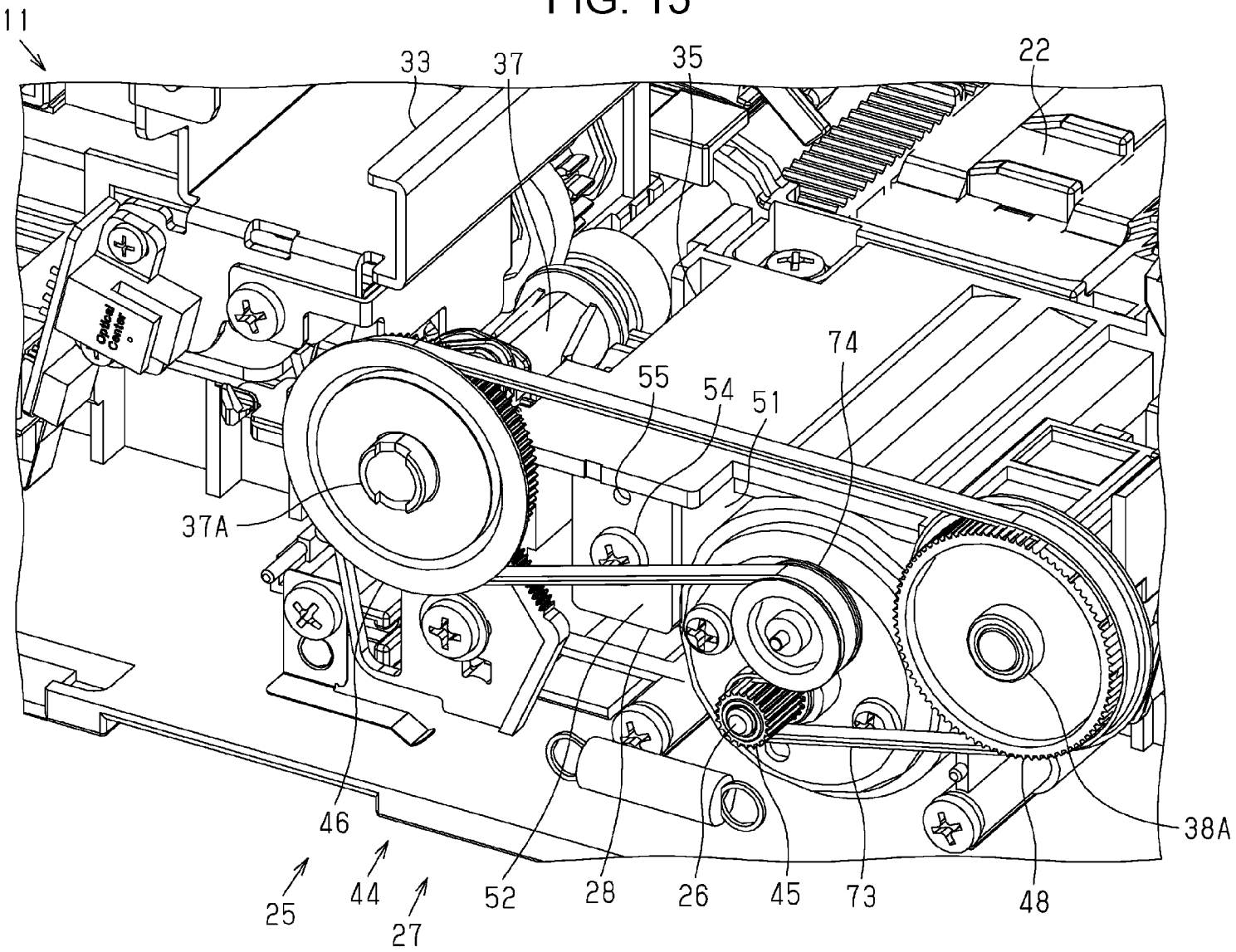
FIG. 15 is a perspective view illustrating a modification of the recording device.

As illustrated in FIG. 15, the transmission mechanism 27 may include a belt 73 in addition to the gears. The belt 73 is wound around the gears. In a modification illustrated in FIG. 15, the second transmission portion 44 includes a first gear 45, a second gear 46, a fourth gear 48, and a pully 74, in addition to the belt 73. This modification does not include the third gear 47. The belt 73 is wound around the first gear 45, the second gear 46, the fourth gear 48, and the pully 74. When the first gear 45 is rotated by the driving member 26, the belt 73 starts rotating. This starts rotation of the second gear 46, the fourth gear 48, and the pully 74. Then, the second and third transportation rollers 37 and 38 start rotating. This modification may be applied not only to the second transmission portion 44 but also to the first transmission portion 43. In this transmission mechanism 27, the drive noise may be large at a position where the first gear 45 and the belt 73 mesh, and thus the sound absorber 28 works effectively.

Figure 16:
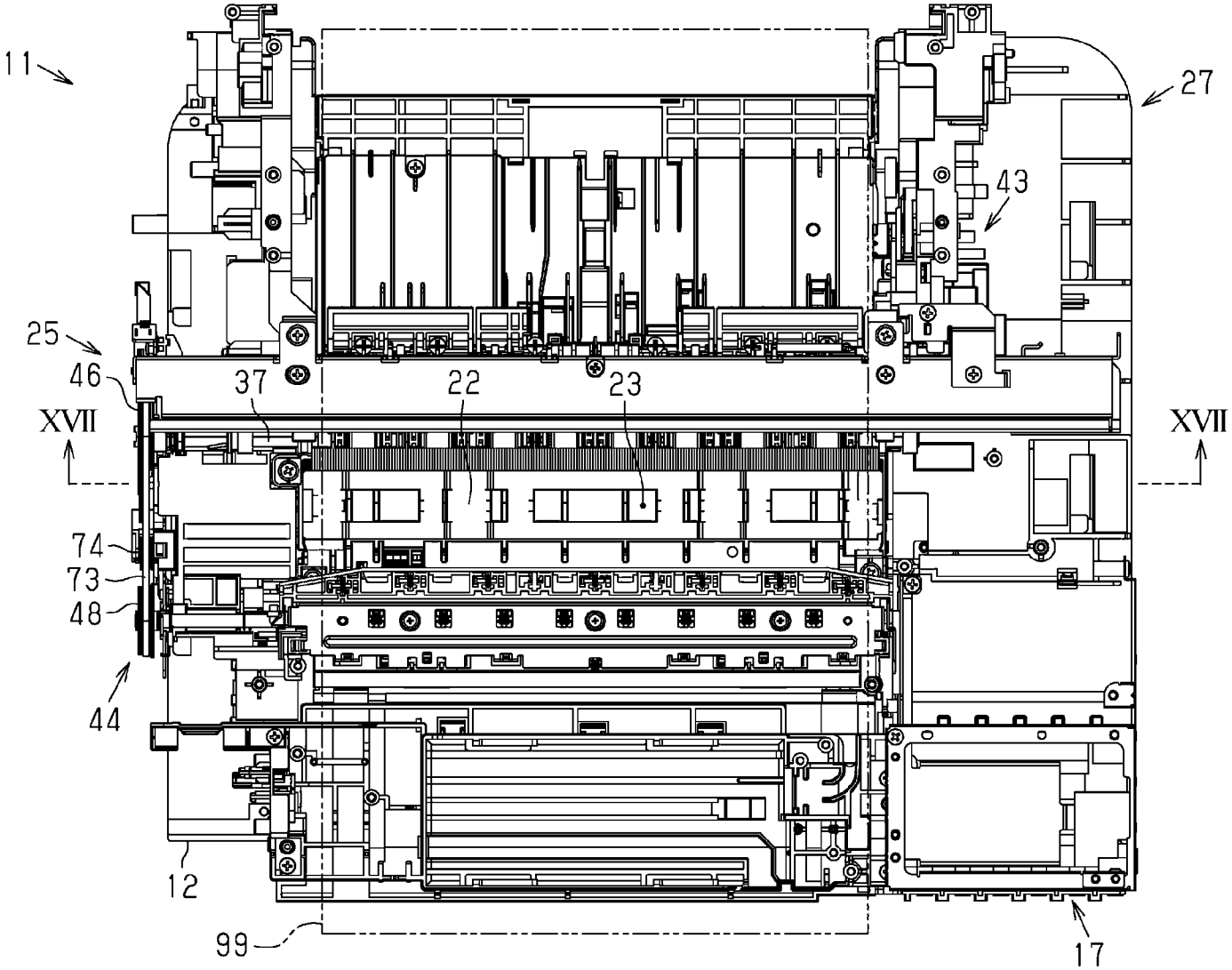
FIG. 16 is a top view of the recording device in FIG. 15.
Figure 17:
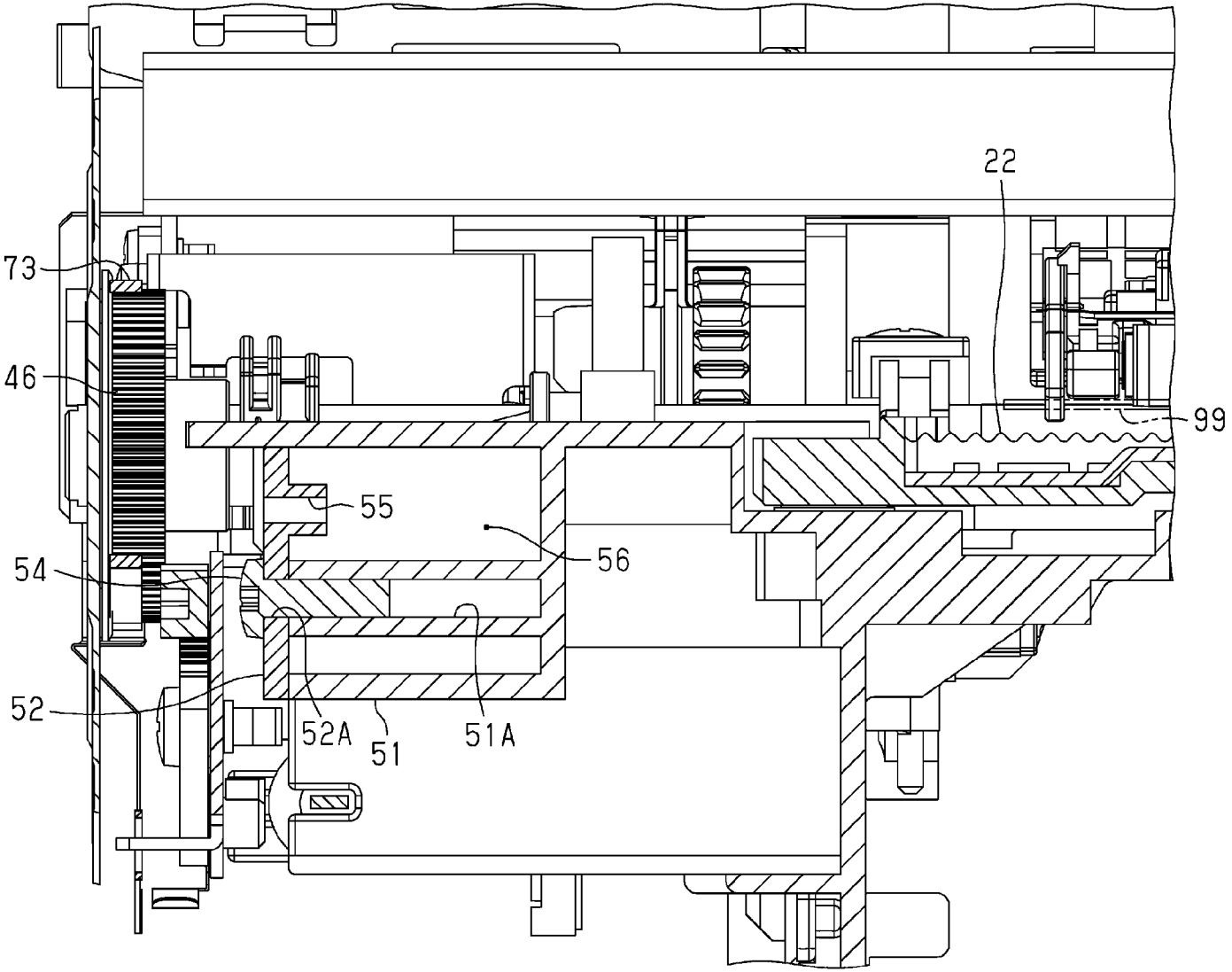
FIG. 17 is a cross-sectional view taken along line XVII-XVII in FIG. 16.

As illustrated in FIGS. 16 and 17, the sound absorber 28 in this modification is also located between the side end of the medium 99 and the gears included in the second transmission portion 44. In FIGS. 16 and 17, the medium 99 indicated by a two-dot chain line has a maximum width recordable by the recording device 11.

As illustrated in FIGS. 15 and 17, the sound absorber 28 may have the openings 55 facing the gears included in the transmission mechanism 27. The drive noise is effectively absorbed because the openings 55 face the source of the drive noise.

The displacement mechanism 29 may move the cover 52 depending on the transportation speed of the medium 99 being transported by the transportation unit 25. The frequency of rotation of the gears included in the transmission mechanism 27 increases as the transportation speed of the medium 99 increases. The frequency of the drive noise generated by the gears is determined by the frequency of rotation of the gears. Thus, for example, the controller 20 may move the cover 52 depending on the value of current flowing through the driving member 26.

The rotation speed of the gears increases as the transportation speed of the medium 99 increases. The frequency of the drive noise increases as the rotation speed of the gears increases. On the contrary, the rotation speed of the gears decreases as the transportation speed of the medium 99 decreases. The frequency of the drive noise decreases as the rotation speed of the gears decreases. As can be seen from this, the transportation speed of the medium 99 is correlated with the rotation speed of the gears.

This modification provides the following effects.

10. The cover 52 is moved by the displacement mechanism 29 depending on the frequency of the drive noise generated by the gears. This configuration enables the sound absorber 28 to effectively absorb the gear drive noise.

The sound absorber 28 may be located between the side end of the medium 99 being transported and the gears included in the first transmission portion 43. The recording device 11 may include a sound absorber that absorbs a drive noise generated by the first transmission portion 43 in addition to the sound absorber 28 that absorbs the drive noise generated by the second transmission portion 44.

The case 51 and the cover 52 may be an integral component.

The displacement mechanism 29 may move up and down the cover 52 relative to the case 51. The displacement mechanism 29 of the above-described embodiment moves down the cover 52 toward the case 51 but may move up the cover 52 relative to the case 51. In other words, the displacement mechanism 29 may move the cover 52 toward or away from the case 51. In such a case, the cover 52 does not need a restoring force of the elastic member 53 to move up. Thus, if the restoring force of the elastic member 53 decreases due to age deterioration, the cover 52 can be moved by the displacement mechanism 29 to increase the volume of the sound absorber 28.

The recording device 11 may include a driving member that drives the displacement mechanism 29 in addition to the driving member 26 that drives the transportation unit 25. In such a case, the driving member is located such that the output shaft of the driving member meshes with the interlocking gear 63. In this modification, the holder 64, the trigger gear 65, and the pusher 66 may be eliminated from the displacement mechanism 29.

The number of driving members 26 is not limited to one and may be two or more.

The driving member 26 may include four driving members 26 that drive the corresponding first, second, third, and fourth transportation rollers 36, 37, 38, and 39.

The recording device 11 may include the driving member 26 that drives the second and third transportation rollers 37 and 38 and another driving member that drives the first and fourth transportation rollers 36 and 39. In such a case, the recording device 11 may be configured such that the second transmission portion 44 transmits the driving force of the driving member 26 to the second and third transportation rollers 37 and 38 and the first transmission portion 43 transmits the driving force of the other driving member to the first and fourth transportation rollers 36 and 39.

The driving member 26 is not limited to a motor that drives the transportation unit 25 and may be a motor that drives a component of the recording device 11 other than the transportation unit 25.

The sound absorber 28 may include one hollow space 56 or three or more hollow spaces 56.

When the sound absorber 28 includes multiple hollow spaces 56, the hollow spaces 56 may have different volumes. Furthermore, the openings 55 may have different opening areas, or the openings 55 may have different lengths.

The recording device 11 may change the resonant frequency of the sound absorber 28 by using the displacement mechanism 29 when a silent mode is selected. When the silent mode is selected, the rotation speed of the gears decreases to reduce the drive noise.

The recording device 11 may include a microphone that detects a gear drive noise. In this configuration, the resonant frequency of the sound absorber 28 may be changed by the displacement mechanism 29 depending on the frequency of the drive noise detected by the microphone.

The recording unit 21 is not limited to the ink jet recording unit and may be an electrophotographic recording unit, which applies light to the medium 99 to fix, for example, toner on the medium 99.

The liquid ejected from the head 31 is not limited to ink and may be a liquid state material including particles of functional material dispersed or mixed in a liquid. For example, the head 31 may eject a liquid state material including a dispersed or dissolved electrode material or pixel material, which is used in the production of a liquid crystal display, an electroluminescence display, and a surface emitting display.

Hereinafter, technical ideas understood from the above-described embodiment and modifications, and operation and effects thereof are described.

A. A recording device includes a recording unit configured to record on a medium, a transportation unit configured to transport the medium, a driving member, a plurality of gears configured to transmit a driving force of the driving member, and a sound absorber having an opening and a hollow space in communication with the opening. The sound absorber is located between a side end of the medium being transported by the transportation unit and the plurality of gears.

In the above-described configuration, the sound absorber is located near the gears. Thus, the sound absorber effectively absorbs the gear drive noise. This reduces the gear drive noise.

B. In the above-described recording device, the plurality of gears may be configured to transmit the driving force of the driving member to the transportation unit.

In the above-described configuration, the drive noise of the gears that transmit the driving force of the driving member to the transportation unit is effectively absorbed.

C. The above-described recording device may include a support facing the recording unit and supporting the medium. The sound absorber may be located between the support and the plurality of gears.

The above-described configuration contributes to a reduction in size of the recording device because the sound absorber is located between the support and the gears.

D. In the above-described recording device, the sound absorber may include a case and a cover attached to the case and having the opening.

In the above-described configuration, the sound absorber has a simple structure.

E. In the above-described recording device, the case may be included in a frame member constituting the support.

In this configuration, the recording device has a simpler structure than that including a case independent from the frame member.

F. In the above-described recording device, the cover may be configured to be moved relative to the case.

In the above-described configuration, the volume of the sound absorber changes as the cover moves. The resonant frequency of the sound absorber changes as the volume of the sound absorber changes. In other words, the frequency of sound to be absorbed by the sound absorber is changed when the cover is moved.

G. The above-described recording device may include a displacement mechanism configured to move the cover relative to the case. The displacement mechanism may include a cam configured to come in contact with the cover. The cam may move the cover in a vertical direction when rotated.

In the above-described configuration, the displacement mechanism moves up and down the cover. In other words, the displacement mechanism changes the frequency of sound to be absorbed by the sound absorber.

H. In the above-described recording device, the recording unit may include a head configured to eject a liquid onto the medium and a carriage having the head thereon and configured to scan the medium. The displacement mechanism includes an attachment shaft to which the cam is attached, an interlocking gear attached to the attachment shaft, and a trigger gear configured to mesh with the interlocking gear. The trigger gear is movable to a first position to mesh with the interlocking gear and to a second position to be unmeshed from the interlocking gear. The trigger gear may be moved from the second position to the first position by being pushed by the carriage.

In the above-described configuration, when the driving member is driven with the trigger gear being positioned at the first position, the cam starts rotating together with the interlocking gear. In other words, the cover is moved up and down by the driving force of the driving member that drives the transportation unit. The recording device has a simpler structure than that including a separate driving member that moves up and down the cover.

I. In the above-described recording device, the displacement mechanism may move the cover depending on a transportation speed of the medium transported by the transportation unit.

The rotation speed of the gears increases as the transportation speed of the medium increases. The frequency of the drive noise increases as the rotation speed of the gears increases. On the contrary, the rotation speed of the gears decreases as the transportation speed of the medium decreases. The frequency of the drive noise decreases as the rotation speed of the gears decreases. As can be seen from this, the transportation speed of the medium is correlated with the rotation speed of the gears. Thus, in the above-described configuration, the cover is moved depending on the frequency of drive noise generated by the gears. This allows the sound absorber to effectively absorb the gear drive noise.

J. The above-described recording device may include a transportation path along which the medium is transported by the transportation unit. The transportation unit may include a first transportation roller located upstream of the recording unit on the transportation path and a second transportation roller located between the recording unit and the first transportation roller on the transportation path. The driving member may include a first motor configured to drive the first transportation roller and a second motor configured to drive the second transportation roller. The plurality of gears may transmit the driving force of the second motor to the second transportation roller.

This configuration reduces the drive noise of the gears driven by the second motor.

What is claimed is:

1. A recording device comprising:

a recording unit configured to record on a medium;

a transportation unit configured to transport the medium;

a driving member;

a plurality of gears configured to transmit a driving force of the driving member; and a sound absorber having an opening and a hollow space in communication with the opening, wherein the sound absorber is located between a side end of the medium being transported by the transportation unit and the plurality of gears.

2. The recording device according to claim 1, wherein the plurality of gears is configured to transmit the driving force of the driving member to the transportation unit.

3. The recording device according to claim 2, further comprising a support facing the recording unit and supporting the medium, wherein the sound absorber is located between the support and the plurality of gears.

4. The recording device according to claim 3, wherein the sound absorber includes a case and a cover attached to the case and having the opening.

5. The recording device according to claim 4, wherein the case is included in a frame member constituting the support.

6. The recording device according to claim 4, wherein the cover is configured to be moved relative to the case.

7. The recording device according to claim 6, further comprising a displacement mechanism configured to move the cover relative to the case, wherein the displacement mechanism includes a cam configured to come in contact with the cover and the cam moves the cover in a vertical direction when rotated.

8. The recording device according to claim 7, wherein the recording unit includes a head configured to eject a liquid onto the medium and a carriage having the head thereon and configured to scan the medium, the displacement mechanism includes an attachment shaft to which the cam is attached, an interlocking gear attached to the attachment shaft, and a trigger gear configured to mesh with the interlocking gear, and the trigger gear is configured to move to a first position to mesh with the interlocking gear and to a second position to be unmeshed from the interlocking gear, and the trigger gear is moved from the second position to the first position by being pushed by the carriage.

9. The recording device according to claim 7, wherein the displacement mechanism moves the cover depending on a transportation speed of the medium transported by the transportation unit.

10. The recording device according to claim 1, further comprising a transportation path along which the medium is transported by the transportation unit, wherein the transportation unit includes a first transportation roller located upstream of the recording unit on the transportation path and a second transportation roller located between the recording unit and the first transportation roller on the transportation path, the driving member includes a first motor configured to drive the first transportation roller and a second motor configured to drive the second transportation roller, and the plurality of gears transmits the driving force of the second motor to the second transportation roller.

* * * * *